US006250373B1

(12) United States Patent
Vecchi et al.

(10) Patent No.: US 6,250,373 B1
(45) Date of Patent: Jun. 26, 2001

(54) CEILING MOUNTED APPARATUS FOR HEATING AND COOLING

(75) Inventors: Gianluca Vecchi, Monza; Maurizio Rabito, Milan; Giorgio Rusignuolo, Vedano Al Lambro, all of (IT); Lee G. Tetu, Baldwinsville, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/603,689

(22) Filed: Jun. 26, 2000

Related U.S. Application Data

(63) Continuation of application No. 09/118,805, filed on Jul. 20, 1998, now abandoned.

(51) Int. Cl.[7] ..... F28D 19/02

(52) U.S. Cl. ..... 165/53; 165/57; 165/126; 165/125; 165/233; 165/313; 165/DIG. 16

(58) Field of Search ..... 165/53, 54, 56, 165/57, 125, 126, 145, 96; 454/233, 313; 62/DIG. 16

(56) References Cited

FOREIGN PATENT DOCUMENTS

| | | | | |
|---|---|---|---|---|
| 59-132024 | | 9/1984 | (JP) . | |
| 0276653 | * | 12/1986 | (JP) | 454/233 |
| 0091746 | * | 4/1987 | (JP) | 454/233 |
| 62-76858 | | 5/1987 | (JP) . | |
| 0150722 | * | 6/1989 | (JP) | 165/145 |
| 402040424 | * | 2/1990 | (JP) | 165/53 |
| 0143034 | * | 6/1990 | (JP) | 165/126 |
| 0143035 | * | 6/1990 | (JP) | 165/53 |
| 225152 | | 10/1991 | (JP) . | |
| 403282130 | * | 12/1991 | (JP) | 165/53 |
| 7-049135 | | 2/1995 | (JP) . | |
| 7-167487 | | 7/1995 | (JP) . | |
| 7-324802 | | 12/1995 | (JP) . | |
| 8-94160 | | 4/1996 | (JP) . | |

* cited by examiner

*Primary Examiner*—Christopher Atkinson

(57) ABSTRACT

A ceiling mounted apparatus draws air upwardly through an inlet and processes the air through heat exchange elements before distributing the air downwardly. The air is preferably distributed downwardly by air discharge structure surrounding the heat exchange elements. The air is ultimately discharged through one or more air discharge ducts positioned relatively close to the air inlet. Each air discharge duct includes a rotatable louver mounted therein that in conjunction with the walls of the duct defines particular paths for the conditioned air in heating versus cooling.

15 Claims, 6 Drawing Sheets

CEILING MOUNTED APPARATUS FOR HEATING AND COOLING

This application is a continuation of Ser. No. 09/118,805 filed Jul. 20, 1998, abandoned.

BACKGROUND OF THE INVENTION

This invention relates to heating or cooling apparatus mounted within a suspended ceiling in a home, office, or other building space. In particular, this invention relates to the processing of air through such apparatus.

It has been heretofore known to mount a heating or cooling apparatus in a suspended ceiling of a room or space that is to be heated or cooled. The thus mounted apparatus typically draws air in through an inlet provided in the apparatus. The thus drawn in air is circulated through appropriate heat exchange elements before exiting through one or more outlets provided in the apparatus.

The ceiling mounted apparatus typically includes a fan device for drawing in the air that is to be processed and discharged. This fan device may create a significant suction pressure at the air inlet. This suction pressure can draw the air being discharged from the ceiling mounted apparatus back into the apparatus. Re-circulation of this discharged air back through the heat exchange elements lowers the heating or cooling efficiency of the apparatus. It may also affect the long term integrity of the heat exchange elements that are being exposed to the re-circulated air that does not need to be further heated or cooled.

The potential for re-circulation of discharged air back through an air intake of a ceiling mounted apparatus has been heretofore addressed by providing air outlets that direct the discharged air away from the air intake. It has however been found that this directional discharge is hard to achieve when the air outlets are relatively close to the air inlet.

It is an object of the invention to provide heating or cooling apparatus mounted within a suspended ceiling that maintains a proper distribution of either heated or cooled air that does not interfere with the intake of air into the same apparatus.

It is another object of the invention to provide heating or cooling apparatus for mounting within a suspended ceiling that defines two distinct air flow paths for conditioned air leaving the apparatus that achieve optimal air flow for both heated and cooled air from the ceiling mounted apparatus.

SUMMARY OF THE INVENTION

The above and other objects are achieved by a ceiling mounted heating or cooling apparatus that draws air upwardly into an inlet and processes the air through heat exchange elements before distributing the air downwardly. The air is preferably distributed downwardly by air discharge structure surrounding the heat exchange elements. The air is ultimately discharged through one or more air discharge ducts positioned relatively close to the air inlet. Each discharge duct includes a rotatable louver mounted therein that guides the air within the duct.

The rotatable louver in each air discharge duct preferably rotates between either of two positions depending on whether warm or cool air is to be discharged. The position of the louver when warm air is to be discharged produces a substantially downward air flow path to the air exiting the duct. The position of the louver when cool air is to be discharged produces a substantially lateral air flow path to the air exiting the duct.

The air is preferably discharged at a minimum distance from the ceiling so as to avoid any smudging of the ceiling. This is accomplished by a gradually curved wall in each air duct that extends laterally outwardly so as to define were the air exits from the duct at the minimum distance from the ceiling.

Another wall of each discharge duct preferably includes a smoothly curved bend of a prescribed angular arc that directs the discharged air away from the air inlet of the apparatus. This wall in each duct is relatively close to the air inlet.

BRIEF DESCRIPTION OF THE DRAWINGS

Other objects and advantages of the present invention will be apparent from the following description in conjunction with the accompanying drawings, in which.

PREFERRED EMBODIMENT

Figure 1:
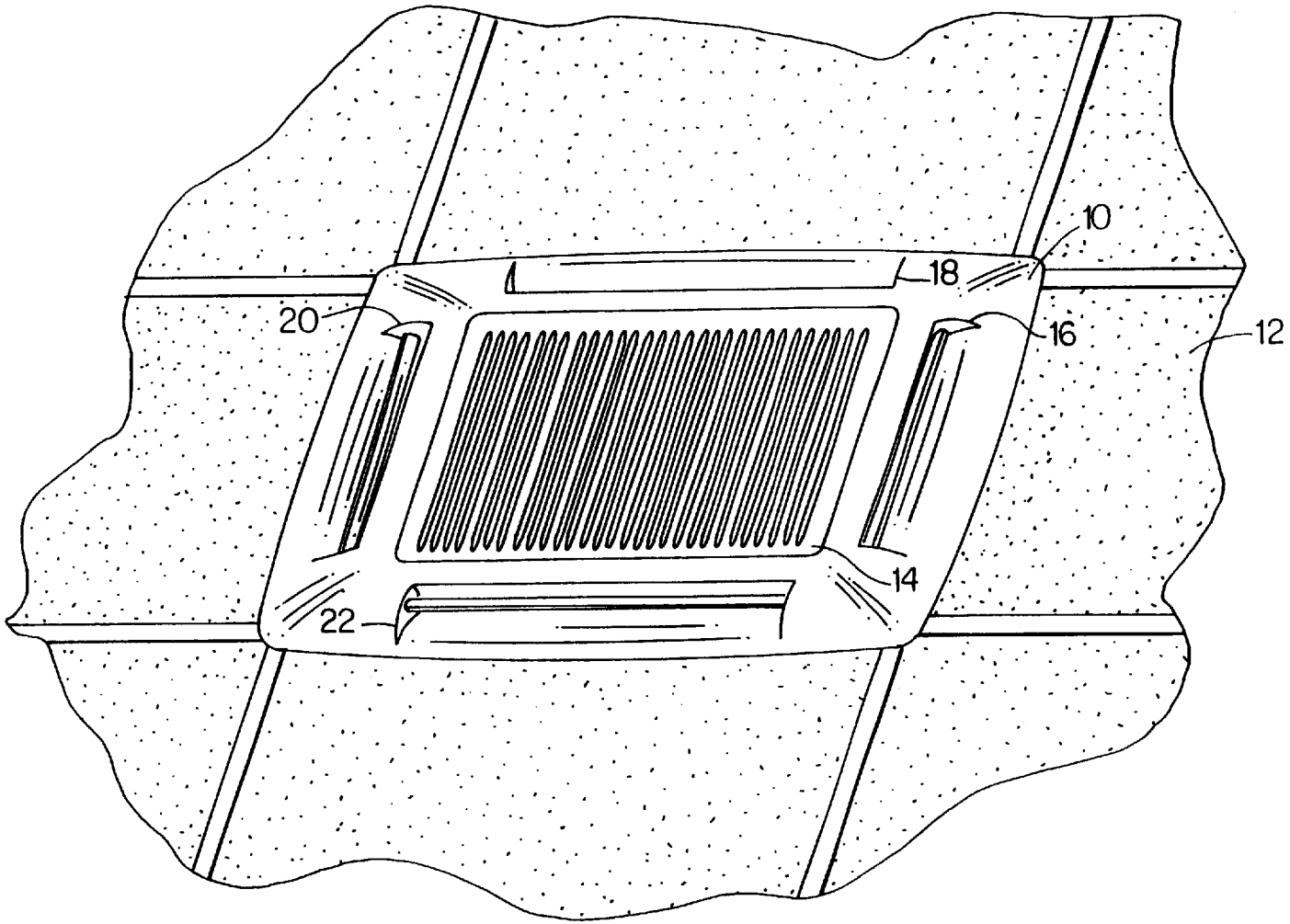
FIG. 1 illustrates a ceiling mounted heating and cooling apparatus having air discharge slots located around the perimeter of a centrally located air intake grill.

Referring to FIG. 1, a ceiling mounted apparatus 10 for heating or cooling air is illustrated in mounted position with respect to a ceiling 12. The apparatus is seen to include a centrally located air intake grill 14, which allows air to be drawn in from the space being heated or cooled. The heating and cooling apparatus also includes four air discharge slots 16, 18, 20 and 22. These air discharge slots each form part of respective air discharge ducts which distribute processed air from the apparatus back into the space being heated or cooled. It is to be noted that each discharge slot is located relatively close to the centrally located grill 14.

Figure 2:
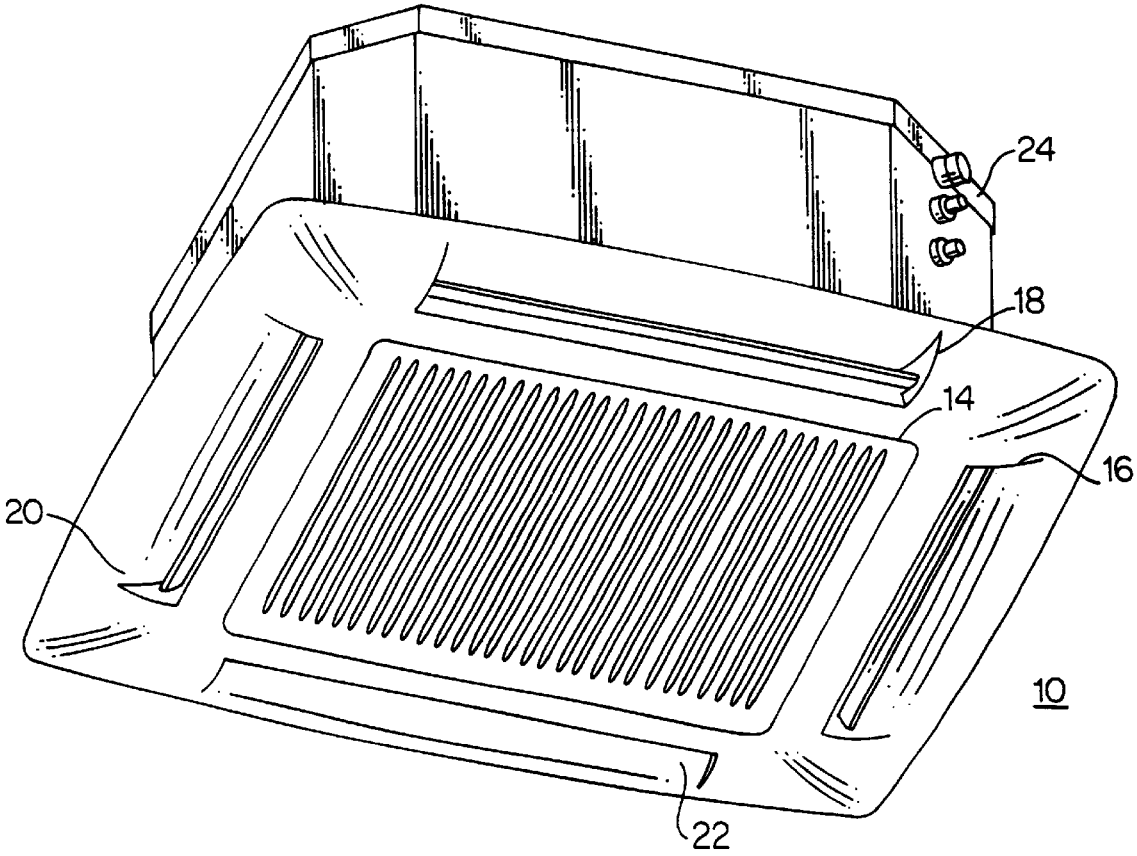
FIG. 2 illustrates the heating and cooling apparatus prior to being mounted in the ceiling of FIG. 1.

Referring to FIG. 2, the heating and cooling apparatus 10 is shown before being mounted within the ceiling 12. It is to be noted that the heating and cooling apparatus includes a housing 24 containing the various components for processing the air that is drawn into the apparatus through the air intake grill 14.

Figure 3:
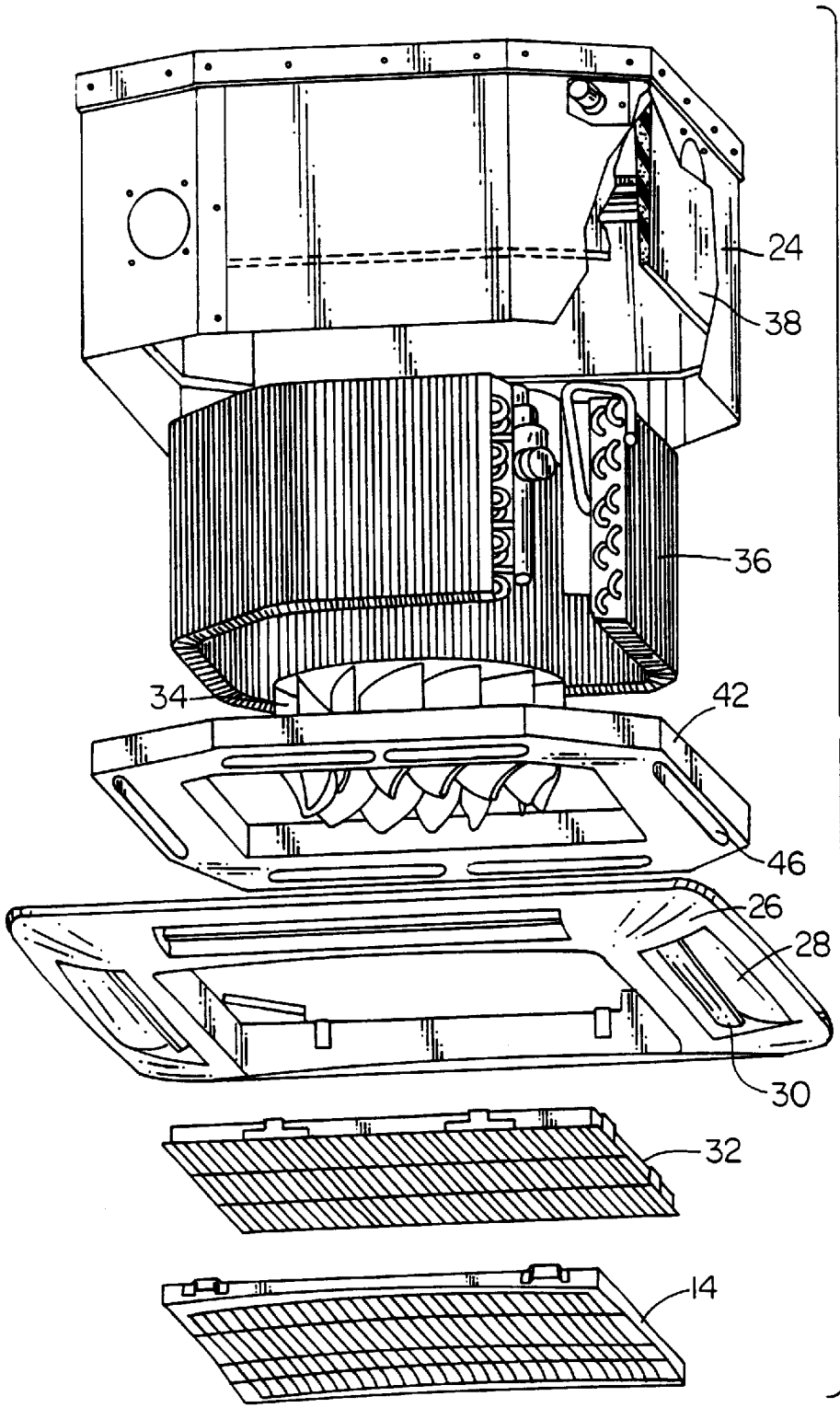
FIG. 3 is an exploded view of the heating and cooling apparatus of FIG. 2.

Referring to FIG. 3, the heating and cooling apparatus 10 is illustrated in an exploded view form. The bottom portion of the heating and cooling apparatus is seen to include a frame 26 in which four air discharge ducts, such as duct 28, are formed therein. Each discharge duct defines one of the respective discharge slots 16, 18, 20 and 22 in the frame 26. A rotatable louver such as 30 is positioned within each air discharge duct. The rotatable louver 30 is seen to extend along the entire length of the duct 28.

An air filter 32 and the intake grill 14 preferably fit into a central opening in the frame 26 and are appropriately secured thereto. The intake grill 14 is preferably square in shape and is curved slightly upwardly toward its center from all four sides.

A centrifugal fan 34 draws air upwardly through the intake grill 14 and the air filter 32. This fan distributes the drawn up air radially outwardly toward heat exchange elements 36. The heat exchange elements preferably consist of a series of coils arranged around the periphery of the centrifugal fan. These coils carry a heat exchange medium which transfers heat to or from a series of heat exchange fins in thermal conducting contact with the coils.

Figure 4:
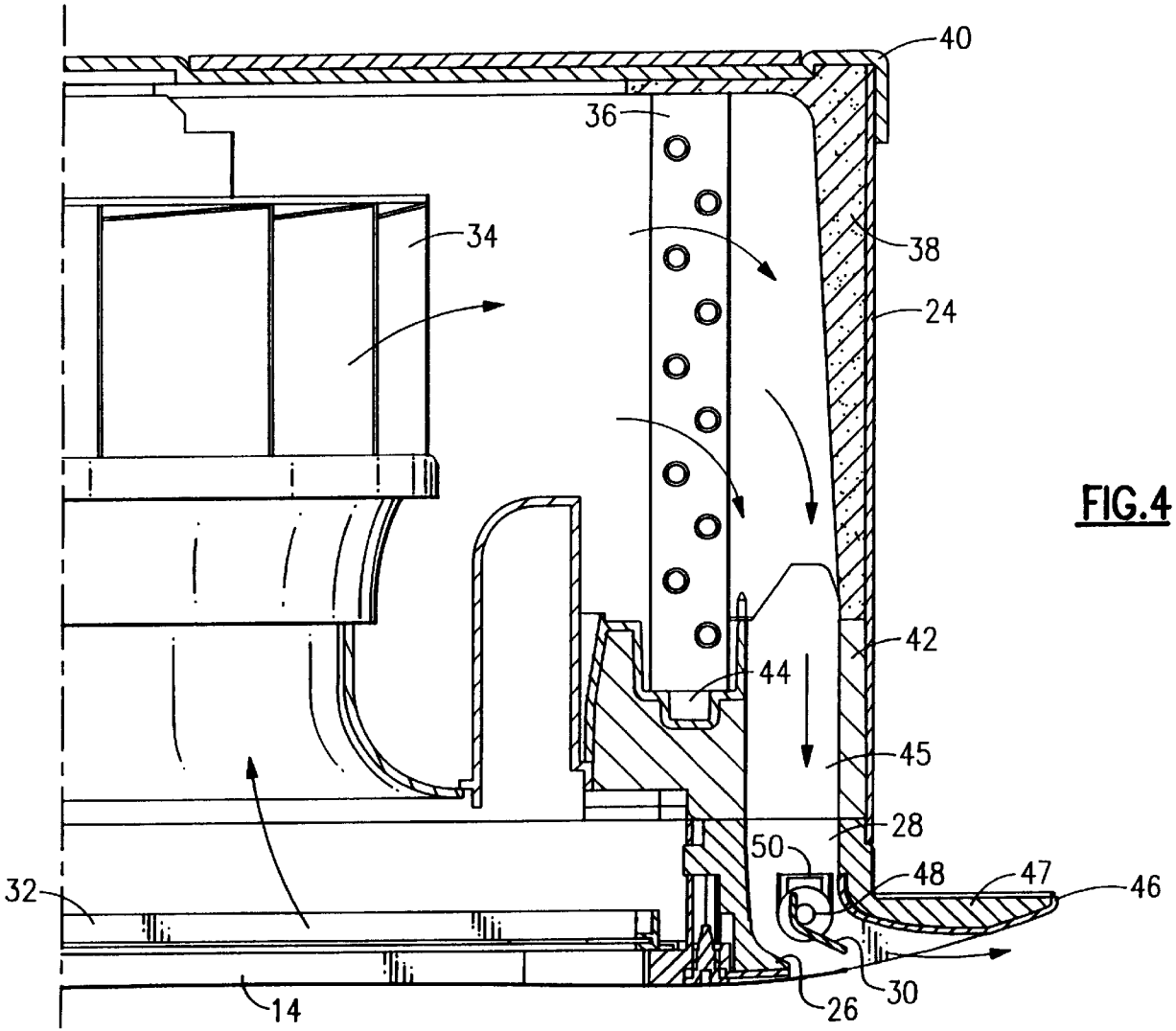
FIG. 4 is a sectional view of the heating and cooling apparatus of FIGS. 2 and 3 illustrating how air is processed from the intake grill to the output of an air discharge duct.

The outwardly flowing air from the centrifugal flow fan 32 is deflected downwardly by air channel structure 38 as shown in FIG. 4. The air channel structure 38 is preferably molded out of polystyrene so as to form a single light insulative piece that fits into the housing 24. The air channel structure 38 is seen to extend inwardly along a top portion 40 of the heating and cooling apparatus to a point beyond the inner perimeter of the fins of the heat exchange elements. The air channel structure also extends downwardly along the inner wall of the housing 24. The air channel structure 38 also is slanted toward the inner wall of the housing 24 so as to define a continuously increasing radial spacing from the heat exchange elements. The air channel structure 38 extends downwardly at this definable slant to the top of a drain pan 42 that is more clearly shown in FIG. 3.

Referring again to FIG. 4, the bottoms of the fins of the heat exchange elements 36 rest in the drain pan 42 so as to allow any condensate from the coils of the heat exchange elements to be collected and drained away in a slot 44. A slotted hole 45 in the drain pan is aligned with respect to the air channel structure 38 so as to define a continuous air channel down to the air duct 28 formed in the frame 26. It is to be noted that similar slotted holes in the drain pan define continuous air channels down to the other respective air discharge ducts in the frame 26.

The cross-section of the frame in FIG. 4 reveals that the frame consists of two different structures. The frame includes an exterior portion 46 preferably molded of a hard plastic. The frame furthermore includes a lightweight molded polystyrene structure 47 above the exterior portion 46.

Referring again to the air channel structure 38, it is to be noted that this structure forms a continuous, smooth, inner wall surface for deflecting the air downwardly. The upper portion of this continuous, smooth, inner wall surface is preferably a curved arc having a constant radius of curvature. The slanted portion of this inner wall is preferably three to five degrees from the vertical. This smooth continuous inner wall assures that all air flows smoothly down to the slotted hole 46 in the drain pan and hence to the air passage duct 28 formed in the frame 26.

Referring to the heat exchange elements 36, it is to be appreciated that these elements will either add heat or remove heat from the air passing over the fins depending on the state of the heat exchange medium flowing through the coils of the heat exchange elements. In this manner, the heating or cooling apparatus will either provide warm or cool air to the air discharge ducts in the frame 26. Referring to the air discharge duct 28 in FIG. 4, it is to be noted that the louver 30 is attached at each end to rotatable members such as 48 which rotates within a bracket 50. As will be explained in detail hereinafter, the louver 30 is rotated to either of two positions depending on whether warm or cool air is flowing through the air discharge duct 28. The rotation of the louver 30 may either be by a motor or through manual adjustment. It is to be appreciated that similar louvers are rotatably mounted and driven to respective positions in each of the other air discharge ducts formed in the frame 26.

Figure 5:
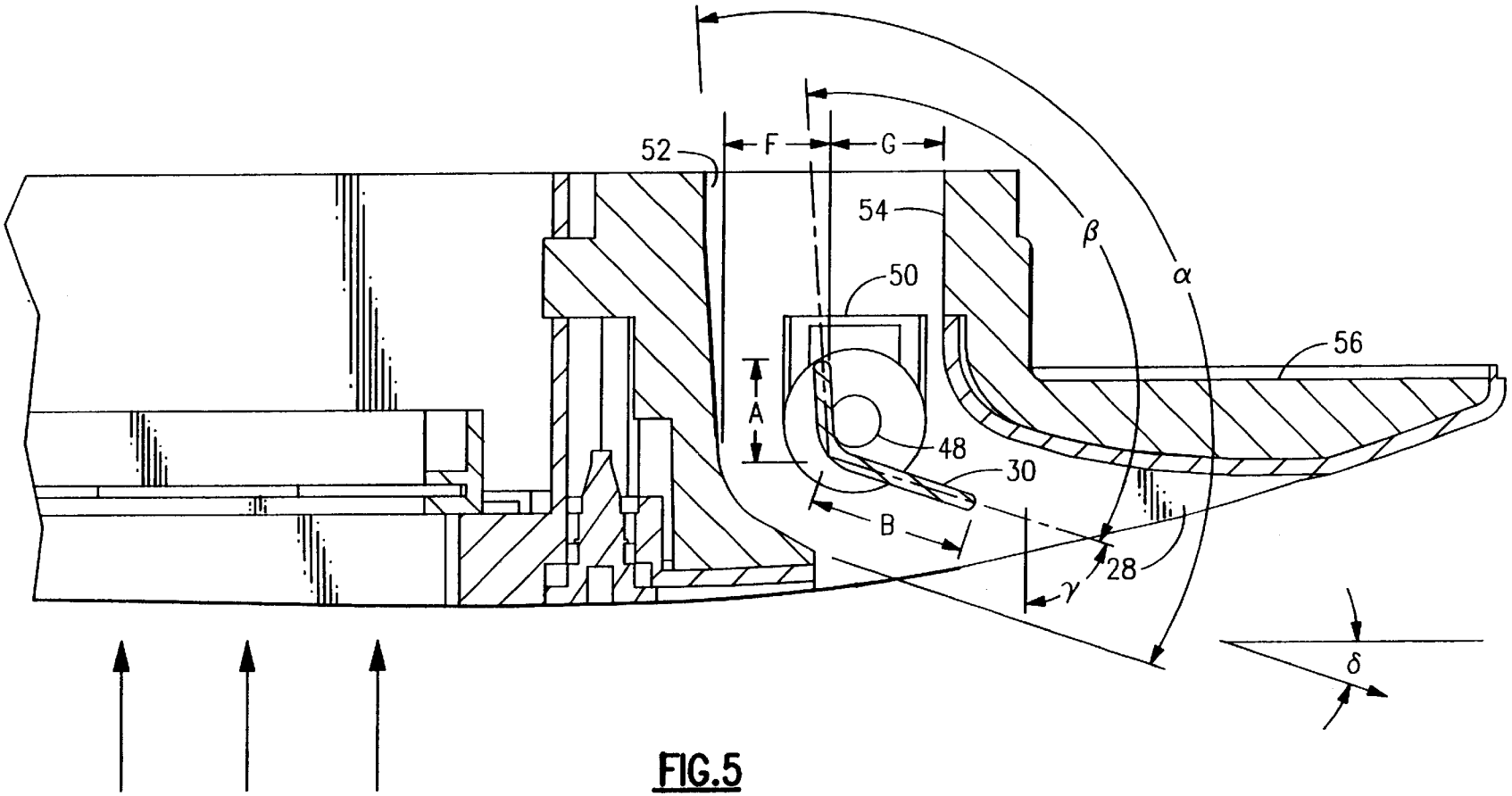
FIG. 5 is an enlarged cross-sectional view of the air discharge passage formed in the bottom most piece of the heating and cooling apparatus of FIGS. 2 and 3.

Referring to FIG. 5, the discharge duct 28 within the frame 26 is further illustrated in an enlarged cross-sectional view. The air discharge duct 28 is seen to comprise two continuous wall surfaces denoted as an inner wall surface 52 and an outer wall surface 54. The inner wall surface 52 is relatively close to the intake grill 14 whereas the outer wall surface 54 is further away from the grill. The outer wall surface 54 is seen to be a part of the frame 26 that extends outwardly in a lateral direction away from the portion of the frame 26 that fits up into the ceiling. This portion of the frame forms a lip 56 that generally fits up against the ceiling when the heating or cooling apparatus is mounted thereto. It is to be noted that the outer wall 54 extends outwardly to a point located at a distance "h" below the top of the lip 56. The distance "h" is preferably in the range of fifteen to twenty millimeters. This height assures that no smudging will occur to the ceiling when air flows out along the smoothly curved wall 54. It is finally to be noted that the beginning of the outer wall surface 54 is substantially vertical before sharply curving to a point where the lip 56 begins. This point is vertically below where the frame 26 fits into the ceiling. The outer wall surface continues almost laterally from this point at a substantially large radius of curvature until reaching the discharge point at the distance "h" below the top of the lip 56 of the frame 26.

Referring now to the inner wall 52, it is to be noted that this wall begins within the frame 26 upstream of where the louver 30 is rotatably mounted within the duct 28. This wall slants slightly from vertical to a point vertically below the horizontal plane containing the axis of rotation of the rotatable member 48. The inner wall 52 thereafter comprises a substantially curved arc before tangentially meeting a straight slanted wall surface immediately upstream of the exit point of the air from the duct 28.

It is to be noted that the total angular change of the inner wall 52 from the first slanted portion of this wall beginning where the duct 28 is formed in the frame 26 to the second slanted straight wall portion ending where the air exits from the duct 28 is denoted by the angle $\alpha$. This angle is determined by the curved arc portion of the inner wall 52 that joins the first and second slanted wall portions of the inner wall. This angular change in the inner wall 52 is preferably within the range of one hundred ten to one hundred thirty degrees. It has been found that when a is greater than one hundred thirty degrees, there is the potential for re-circulation of the air back into the inlet grill 14. It has also been found that when a is less than one hundred ten degrees, there is a poor discharge of heated air.

Referring now to the rotatably mounted louver 30, it is seen that this louver comprises two leg portions joined together by a curved arc portion therebetween. The curved arc portion defines an angle $\beta$ between the two straight leg portions of the louver. The curved arc portion preferably has a constant radius of curvature so that the angle $\beta$ defines the total angular measurement in degrees of arc defined by such a radius. The angle $\beta$ is preferably in the range of one hundred ten to one hundred twenty degrees.

The two straight leg portions of the louver 30 preferably define linear dimensions "A" and "B". These linear dimensions are defined by extending the center lines of these leg portions until they intersect at a point in the vicinity of the curved arc portion. The dimension "A" is measured from the tip of the upper leg portion along the center line of this upper leg portion of the louver to the aforementioned point of intersection of the center lines. The dimension "B" is measured along the center line of the lower straight leg portion from the aforementioned point of intersection to the tip of the lower leg of the louver. The ratio "A/B" of these dimensions is preferably in the range of 0.4 to 0.6. It has been found that an A/B ratio of less than 0.4 produces poor discharge of air with the potential for re-circulation problems with respect to the air intake grill 14. An A/B ratio greater than 0.6 creates a louver that is too sensitive to rotational positioning.

It is to be noted that the louver 30 is shown in FIG. 5 in its normal position for processing cooled air within the air discharge duct 28. In this regard, the point of intersection of the dimensioned lengths "A" and "B" of the louver is preferably at a lateral distance "F" from the point of the inner wall 52 where the curved arc portion begins. The point of intersection of the lengths "A" and "B" of the louver is also at a lateral distance "G" from the top most point of the outer wall 54. The ratio of these dimensions, F/G, is preferably between 0.8 and 1.2.

The lower leg of the louver 30 during cooling is preferably at an angle $\gamma$ of sixty to seventy-five degrees from vertical. This angle allows for substantial air flow to either side of the louver. This thus positioned louver produces a directional discharge of air from the duct 28 defined by the angle $\delta$. The angle $\delta$ as measured from horizontal will be between five and twenty degrees when the lower leg of the louver is at the angle $\gamma$.

Figure 6:
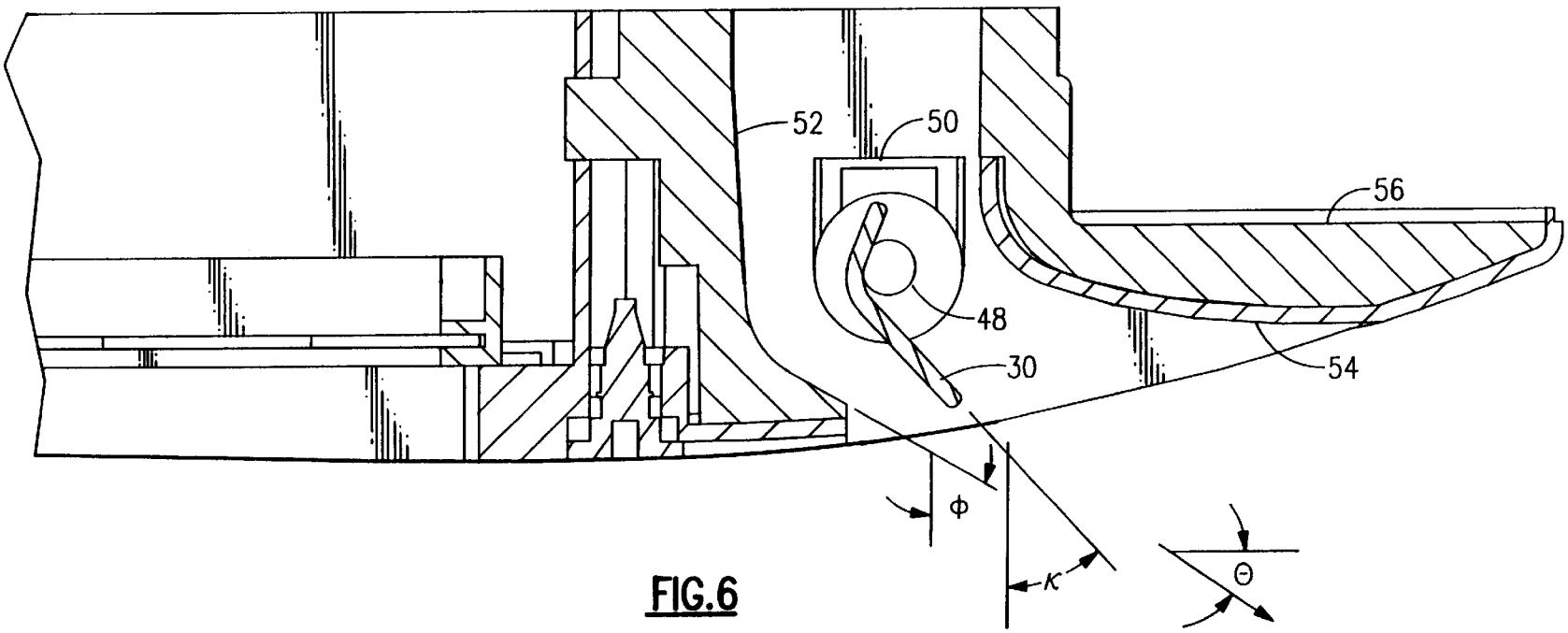
FIG. 6 is an enlarged cross-sectional view of the air discharge passage of FIG. 5 when the rotated louver therein is in a position for distributing heated air.

Referring now to FIG. 6, the louver 30 is illustrated in the heating mode position. In this regard, the louver 30 has been preferably rotated clockwise by twenty-five degrees from the cooling mode position so that the lower leg portion moves toward the inner wall 52 whereas the upper leg portion moves towards the outer wall 54. The lower leg portion of the louver 30 is now at a angle $\kappa$ of thirty-five to fifty degrees from vertical. The thus positioned louver now tends to deflect the air from its otherwise normal outward flow dictated by the slant of the inner wall 52 at the air exit point from the duct 28. In this regard, the lower leg of the louver 30 tends to deflect the heated air substantially downwardly with less of a lateral component than when the louver 30 is in the cooling mode position. The angle of discharge, $\theta$, is preferably in the range of forty to fifty-five degrees from horizontal. It is to be noted that this angle has a lateral component that is substantially less than the lateral component of the angle $\delta$ defining the air discharge direction in the cooling mode.

Referring to the inner wall 52 and, in particular, to the angular slope of this wall near the exit point of the air from the duct 28. This angular slope is denoted as $\phi$ in FIG. 6. This angle as measured from vertical is preferably midway between a given value of $\kappa$ and a given value of $\gamma$ used in a particularly designed duct. This normally results in the angle $\phi$ being in the range of fifty-five to sixty-five degrees. This allows the air flow closest to the inner wall to have a substantial lateral component in both heating and cooling so as to reduce the risk of any recirculating air to the air intake grill 14.

Referring again to the angles $\alpha$ and $\beta$, denoting the angular arc of curvature of the inner wall surface 52 and the louver 30, respectively. It is to be noted that these angular arcs allow for a substantial air flow along the inner wall 52 of the air duct 28 in both heating and cooling. If the angle $\alpha$ of the arc of the inner wall is however less than one hundred-ten degrees, then the exit slope angle $\phi$ of this wall increases thereby producing excessive pressure loss on the inner wall side of the louver during heating mode. On the other hand, if the angle a is greater than one hundred-thirty degrees, then the exit slope $\phi$ decreases to the point where discharged air may recirculate into the grill.

It is to be appreciated that the thus shaped air duct passage 28 in combination with the thus shaped louver 30 defines two separate distinct air paths to either side of the louver. These paths produce a first directional air discharge for cooling versus cooling a second directional discharge for heating. The air discharge path for cooling moves the air substantially laterally outwardly from the apparatus so as to avoid creating a cold draft on people within the room being cooled by the ceiling apparatus. In contrast, the air discharge in heating is substantially more downward to counteract the tendency of heated air to normally rise and thereby not circulate toward the people in the room.

It is to be finally appreciated that a preferred embodiment of the invention has been described. Alterations, modifications and improvements thereto will readily occur to those skilled in the art. Accordingly, the foregoing is by way of example only and the invention is to be limited only by the following claims and equivalents thereto.

What is claimed is:

1. Ceiling mountable apparatus for heating or cooling air, said apparatus comprising:

an external housing;

a frame containing an air inlet, said frame fitting into said external housing;

a fan within the external housing for drawing air up through the air inlet in said frame and for subsequently distributing the drawn in air radially outwardly;

a plurality of heat exchange elements positioned radially outwardly of said fan for heating or cooling the radially distributed air from said fan;

air channel structure positioned within the external housing relative to said fan so as to deflect the radially distributed air from said fan downwardly; and at least one air discharge duct in said frame containing the air inlet, said discharge duct having a first wall located near at least one edge of the air inlet and a second wall opposite said first wall which is located further outwardly from the edge of the air inlet than said first wall, wherein said first and second walls are smooth, continuous walls formed in said frame wherein said first wall in said discharge duct comprises a first straight wall portion followed by a curved wall portion followed by a second straight wall portion terminating where air is discharged from the discharge duct, said second straight wall portion being at an angle relative to said first straight wall portion so as to direct air discharged from the discharge duct away from the air inlet.

2. The apparatus of claim 1 wherein the curved wall portion of said first wall defines an angular arc in the range of one hundred ten to one hundred thirty degrees between said first and second straight portions of said first wall.

3. The apparatus of claim 2 wherein the second straight wall portion terminating where air is discharged from the discharge duct is at an angle from vertical in the range of fifty-five to sixty-five degrees.

4. The apparatus of claim 2 further comprising:

a rotatable louver mounted within said discharge duct, said rotatable louver having first and second straight leg portions which are joined together by a curved arc portion therebetween.

5. The apparatus of claim 4 wherein said curved arc portion between said first and second straight leg portions comprises an arc in the range of one hundred ten to one hundred twenty degrees.

6. The apparatus of claim 5 wherein the centerlines of said first and second straight leg portions intersect at a point so as to define a first linear dimensional length "A" along the centerline of the first leg from the point of intersection to the tip of said first leg and a second linear dimensional length "B" along the centerline of the second leg from the point of intersection to the tip of the second leg and wherein the ratio of A/B is within the range of 0.4 to 0.6.

7. The apparatus of claim 6 wherein the rotatable louver is rotatable to a first position when the air is being cooled by said heat exchange elements whereby the point of intersection of said first and second center lines is at a horizontal distance, "F", from the point of the first wall where the first straight wall portion ends and the curved wall portion begins and at a horizontal distance, "G", from the top point of the second wall formed in the frame wherein the ratio of F/G is 0.8 to 1.2.

8. The apparatus of claim 7 wherein the second straight leg portion of said rotatable louver is at an angle from vertical of between sixty and seventy-five degrees when said rotatable louver is in the first position.

9. The apparatus of claim 8 wherein said rotatable louver is rotatable to a second position when the air is being heated by said heat exchange elements wherein the second straight leg portion of said rotatable louver is at an angle from vertical of between thirty-five and fifty degrees.

10. The apparatus of claim 5 wherein said rotatable louver is rotatable to a first position when the air is being cooled by said heat exchange elements wherein the second straight leg portion of said rotatable louver is at an angle from vertical between sixty and seventy-five degrees.

11. The apparatus of claim 10 wherein said rotatable louver is rotatable to a second position when the air is being heated by said heat exchange elements wherein the second straight leg portion of said rotatable louver is at an angle from vertical of between thirty-five and fifty degrees.

12. The apparatus of claim 1 wherein the second wall in said discharge duct includes a continuously curved portion extending laterally outwardly toward an outer edge of said frame, said curved portion defining the closest air exit point to a ceiling surface when the ceiling mountable apparatus is mounted to a ceiling.

13. The apparatus of claim 12 wherein the closest air exit point to a ceiling surface is at a vertical distance from the ceiling surface that is within a range of fifteen to twenty millimeters.

14. The apparatus of claim 1 wherein said air channel structure positioned within the external housing comprises:

a continuous structure surrounding said heat exchange elements and radially spaced therefrom at increasing radial distances as said continuous structure extends downwardly from a point above said heat exchange elements to a point below said heat exchange elements.

15. The apparatus of claim 14 wherein said continuous structure furthermore curves radially inwardly above said heat exchange elements so as to define a smooth curved air channel beginning above said heat exchange elements.

* * * * *